United States Patent [19]

Slater et al.

[11] 4,249,605

[45] Feb. 10, 1981

[54] SECONDARY RECOVERY METHOD AND SYSTEM USING SOLAR ENERGY AND CONCENTRIC TANK SEPARATOR

[76] Inventors: Frank W. Slater, P.O. Box 186; Dale Fuqua, Box 247, Star Rte., both of Durant, Okla. 74701

[21] Appl. No.: 62,236

[22] Filed: Jul. 27, 1979

Related U.S. Application Data

[63] Continuation-in-part of Ser. No. 871,966, Jan. 24, 1978, Pat. No. 4,174,752.

[51] Int. Cl.[3] ..... E21B 43/24; E21B 43/40; F24J 3/02

[52] U.S. Cl. ..... 166/266; 126/432; 126/435; 166/57; 166/267; 166/272

[58] Field of Search ..... 166/266, 267, 272, 303, 166/57; 126/435, 432

[56] References Cited

U.S. PATENT DOCUMENTS

| | | | |
|---|---|---|---|
| 2,261,057 | 10/1941 | Erwin | 166/266 X |
| 2,688,368 | 9/1954 | Rodgers et al. | 166/267 |
| 2,953,204 | 9/1960 | Doscher et al. | 166/266 |
| 3,152,442 | 10/1964 | Rowekamp | 126/435 X |
| 3,354,952 | 11/1967 | Engle | 166/266 |
| 4,108,160 | 8/1978 | Harper | 126/435 X |

*Primary Examiner*—Stephen J. Novosad
*Attorney, Agent, or Firm*—Harvey B. Jacobson

[57] ABSTRACT

A secondary oil recovery method and system utilizing a concentric tank arrangement receiving crude oil from an oil well in the inner tank thereof with the crude oil being heated by a solar furnace to facilitate separation of water, oil and gas with the water being disposed within the outer tank for insulation of the inner tank and for use in an injection well for water flooding with the gas being removed from the inner tank from a dome trap at the top thereof and separated oil being moved to a storage tank or other point of use from the inner tank. The solar furnace includes heat exchange tubes disposed in the inner and outer tanks and oriented in relation to a heat collector panel and provided with a heat exchange medium therein by which solar energy is used to heat the crude oil in the inner tank as well as the water at the bottom thereof and water in the outer tank.

9 Claims, 3 Drawing Figures

SECONDARY RECOVERY METHOD AND SYSTEM USING SOLAR ENERGY AND CONCENTRIC TANK SEPARATOR

CROSS-REFERENCE TO RELATED APPLICATION

This application is a continuation-in-part of our co-pending application Ser. No. 871,966, filed Jan. 24, 1978, for Secondary Recovery Method and System for Oil Wells Using Solar Energy now U.S. Pat. No. 4,174,752, issued Nov. 20, 1979.

BACKGROUND OF THE INVENTION

1. Field of the Invention

The present invention relates to a method and system for secondary recovery of oil by injection of water into injection wells for water flooding of oil bearing formation with the crude oil recovered from the recovery or production well being pumped into a concentric tank separator heated by solar energy for effective separation of gas, oil and water with the gas and oil being discharged to storage or other point of use and the heated water serving as an insulator for the inner tank of the separator and being recirculated back to the injection wells for more effective water flooding.

2. Description of Relevant Art

Secondary oil recovery methods and systems have been employed for a number of years in order to recover a larger percentage of crude oil from the oil bearing strata or formation. One method and system which has been employed is water flooding which basically involves the injecton of water or other flowable medium into an injection well or injection wells spaced from a production or recovery well so that the flooding medium which is pumped into the injection well or injection wells under pressure will cause crude oil in the formation to migrate toward the production well or recovery well thus enabling it to be pumped to storage in a conventional manner. While such methods and systems have operated with some degree of success, in our co-pending application there is disclosed a method and system or apparatus in which at least a portion of the recovered crude oil is heated and injected into the oil formation to provide a greater recovery of crude oil from the formation. The apparatus in the co-pending application includes a device for using solar energy to heat the crude being recirculated into the oil formation. That apparatus and method and the art cited in the co-pending application are incorporated herein by reference thereto.

SUMMARY OF THE INVENTION

An object of the present invention is to provide a secondary recovery method and system utilizing solar energy combined with a separator for separating the crude oil pumped from a production or recovery well into gas, oil and water with the separator including concentric tanks with the inner tank receiving the crude oil and being heated by the solar energy to facilitate separation into gas, oil and water with the separator including an outer tank receiving heated water to serve as an insulator and heat sink for the crude oil in the inner tank and as a reservoir for heated water to be injected into the injection well or wells.

Another object of the invention is to provide a secondary recovery method and system as set forth in the preceding object in which the solar energy is provided by a solar furnace including a collector panel mounted on top of the separator tank and transferring heat to the water and crude oil through a heat exchange fluid circulating through heat exchange tubing.

Still another object of the invention is to provide a secondary recovery method and system as set forth in the preceding objects in which the separator serves as a temporary storage tank with a dome trap at the upper end for collecting gas separated from the crude oil and the exterior of the tank is provided with insulating material to reduce heat loss from the heated crude and water within the separator.

Yet another object of the invention is to provide a secondary recovery method and system using solar energy and a concentric tank separator which is relatively simple in construction, is low cost in operation and effectively utilizes solar energy to facilitate recovery of crude oil from an oil bearing formation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
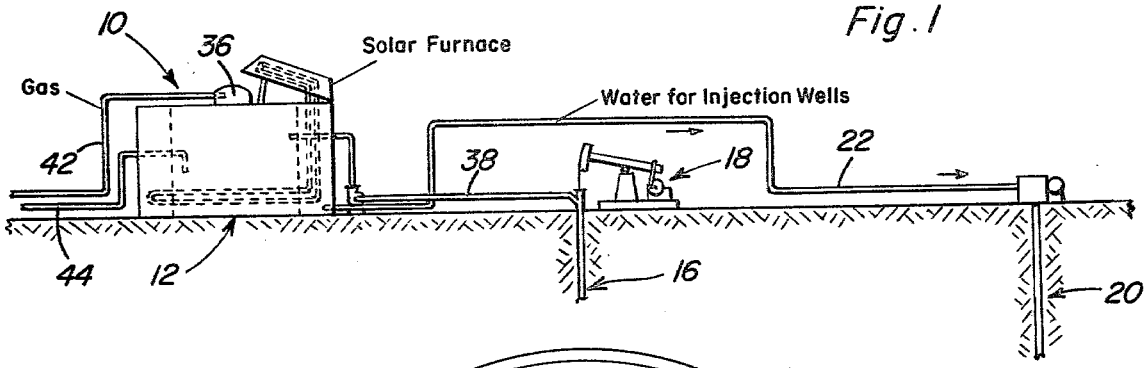
FIG. 1 is a schematic side elevational view illustrating the secondary recovery method and system of the present invention
Figure 2:
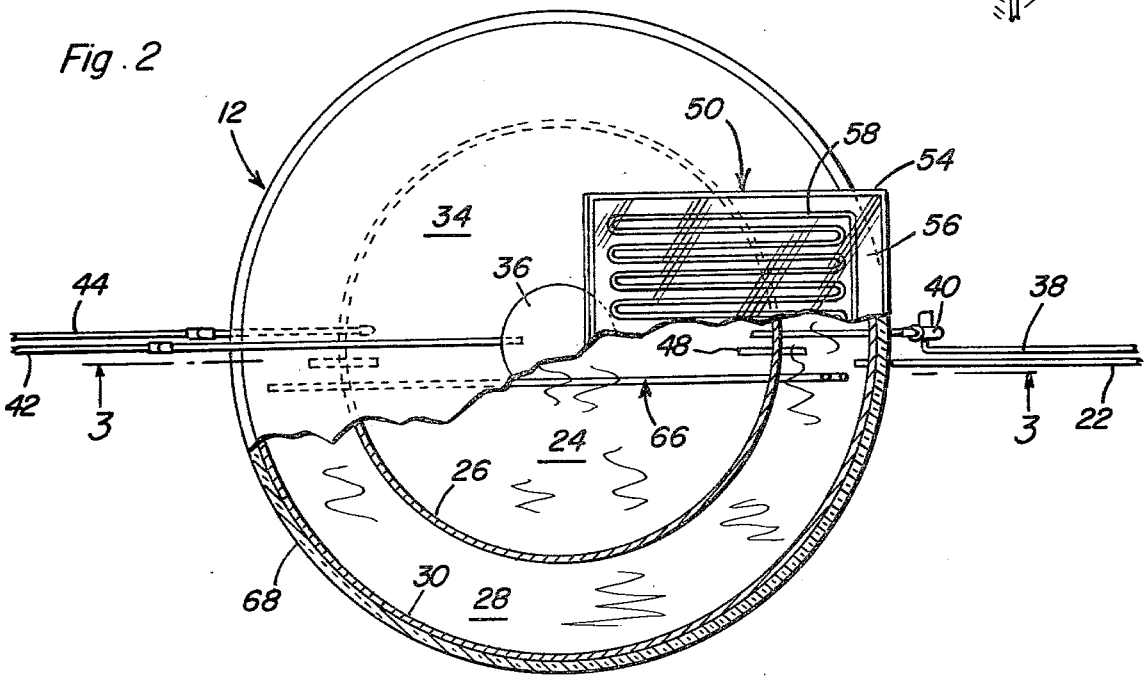
FIG. 2 is a plan view of the separator tank assembly with a portion of the solar furnace and top of the tank being broken away illustrating the structural details thereof.

Referring now specifically to the drawings, the secondary oil recovery method and system of the present invention is generally designated by numeral 10 and includes a tank generally designed by the numeral 12 which serves as a separator and temporary storage for crude oil 14 which is pumped from a recovery well or production well generally designated by numeral 16 by a conventional pump jack 18 and downhole pump (not shown) all of which are conventional components with the tank 12 being the essential component of the present invention. Also shown in FIG. 1 is an injection well 20 spaced from the recovery well 16 with a waterline 22 being connected to the injection well 20 in a conventional manner for flooding the oil bearing strata or formation to enable a larger percentage of the oil in the formation to be recovered at the recovery well 16. This flooding technique is well-known and conventional except that in the present invention, the water injected into the injection well or wells 20 through the waterline 22 is heated and temporarily stored in a unique manner to be set forth in detail hereinafter.

The tank 12 includes an inner tank 24 defined by an inner wall 26 and an outer tank 28 defined by an outer wall 30 spaced from the inner wall 26 and in concentric relation thereto. As illustrated, the walls 26 and 30 are cylindrical in configuration and concentric but the shape and configuration thereof may vary. The lower end of the concentric walls 26 and 30 are interconnected by a bottom wall 32 which also forms a closure for the bottom of the inner tank 24. Thus, the bottom 32 forms an imperforate bottom for the tank 12. The top of the tank 12 is closed by a top wall 34 which has a centrally disposed dome 36 incorporated therein or attached thereto to provide a gas trap with the dome being in communication with only the inner tank 24. The crude oil from the well 16 is conveyed to the inner tank 24 by a pipeline 38 and a suitable pump 40, if necessary, depending upon the distance and other conditions with respect to the relationship of the tank 12 to the recovery well 16.

Figure 3:
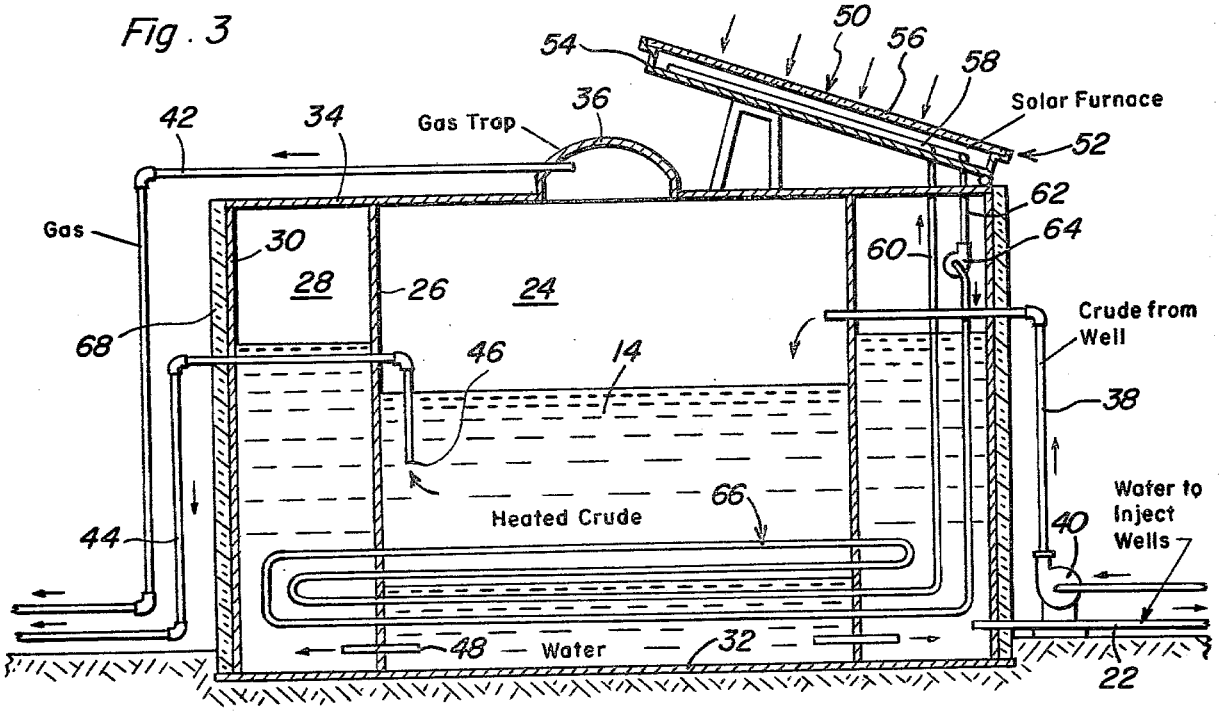
FIG. 3 is a vertical sectional view, taken substantially upon a plane passing along section line 3—3 on FIG. 2, illustrating further structural details of the separator tank.

As illustrated in FIG. 3, the crude oil 14 in the inner tank 24 is heated and separated into gas, oil and water with the gas accumulating in the dome 36 and being conveyed to a storage tank or other point of use by a pipeline 42 communicating with the dome gas trap 36. The heated crude oil is discharged to a storage tank through a pipeline 44 and a pump, if necessary, with the inner end of the pipe 44 communicating with the inner tank 24 at a point generally at or slightly below the vertical center of the inner tank 24 as indicated by numeral 46 in order to make certain that the upper level of the crude 14 in the inner tank 24 will normally be disposed above the inlet point 46 for the heated oil discharge pipe 44. Water that separates from the heated crude oil will accumulate in the bottom of the inner tank 24 and is discharged from the heated inner tank 24 into the outer tank 28 by a plurality of connecting tubes or pipes 48 which extend radially through the lower end portion of the peripheral wall 26 as illustrated in FIG. 3. The heated water in the bottom of inner tank 24 and in the outer tank 28 is used as heated water to inject into the injection well or wells 20 through pipelines 22 and an appropriate injection pump of conventional construction. Gas is discharged through the gas pipe 42 to a storage tank or other point of use or sale and heated crude oil is discharged from the pipe 44 into a storage tank or other point of use, sale or refinement.

In order to heat the crude oil, a solar furnace generally designated by numeral 50 is provided on top of the tank 12 although it could be mounted in other locations adjacent thereto depending upon the manner in which the tank is supported. As illustrated, the tank is mounted on the ground surface or partially embedded therein with the supporting arrangement therefor being conventional. In this embodiment, the solar furnace is mounted on top of the tank 12 and includes a generally hollow rectangular collector panel generally designated by the numeral 52 which includes a box-shaped housing 54 having a transparent cover 56 thereon and receiving a heat exchange coil or tube 58 therein which represents a conventional solar collector with a heat exchange medium such as "Freon" or any other halogenated hydrocarbon or other heat exchange fluid. The heat exchange tubing or coil includes vertical tubes 60 and 62 which extend downwardly through the outer tank 28 with a pump 64 being provided in the downwardly extending tube in which the heat exchange medium flows from the collector 52 although in some instances, the pump 64 may not be necessary. The tubes 60 and 62 then extend horizontally from one side of the outer tank 28 through the inner tank 24 and through the opposite side of the outer tank 28 as illustrated in FIG. 3 and define a heat exchange coil generally designated by the numeral 66 in the form of multiple loops disposed in the inner tank 24 and partially in the outer tank 28 so that solar energy will be absorbed by the working fluid or heat exchange medium and transferred to the inner and outer tanks to maintain the crude oil and water at a desired elevated temperature. The elevated temperature may vary but should be at least 90° F. and may reach approximately 160° F. or 180° F. depending upon the capability of the solar furnace to collect and transfer solar energy. Also, an auxiliary heater such as a gas fired heater, oil fired heater, electric resistance heater, or the like, may be provided in the inner tank as a back-up heat source in the event a series of cloudy days occur or a prolonged period of inclement weather occurs. The outer surface of the tank 12 is provided with insulation 68 around the outer wall 30 and over the top wall, if desired, in order to reduce heat loss and enable the heat sink formed by the water in the outer tank 28 to maintain elevated temperature of the crude oil for a period of time, such as during the night time, so that under average circumstances, the solar furnace 50 will provide all of the heat necessary to effectively heat the crude oil and water to more efficiently separate the gas and water from the crude oil and also heat the water used for injection into the injection wells thereby more efficiently extracting oil from the oil formation by flooding the formation with heated water.

The gas entrained in the crude oil usually will maintain an elevated pressure within the inner tank so that the level of the oil 14 therein is slightly below the level of the water in the outer tank although the pressure in the inner tank is relatively low, on the order of 20 to 25 pounds per square inch. The size, shape and configuration of the solar furnace may vary depending upon the requirements of each installation inasmuch as the heat produced depends, at least in part, to the size and location of the solar collector or collectors. Any suitable bracket structure may be provided for supporting the solar furnace from the top wall of the tank or the solar collectors may be supported from ground or other supporting structure adjacent to or even remote from the separator tank 12.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A method for secondary recovery of crude oil from an oil bearing formation comprising the steps of depositing a mixture of crude oil, gas and water from a recovery well into a separator tank, heating the mixture in the separator tank to facilitate separation of gas, crude oil and water, removing the separated gas from the separator tank, removing the separated oil from the separator tank, removing the separated heated water from the separator tank, utilizing the removed heated water to further heat said mixture in the separator tank, and injecting at least a portion of the separated heated water into the oil bearing formation through an injection well to facilitate recovery of crude oil from the formation.

2. The method as defined in claim 1 wherein the step of heating the mixture in the separator tank includes the step of utilizing solar energy by circulating a heat exchange medium from a solar collector through a heat exchange coil in the separator tank.

3. A method for secondary recovery of crude oil from an oil bearing formation comprising the steps of depositing a mixture of crude oil, gas and water from a recovery well into a separator tank, heating the mixture in the separator tank to facilitate separation of gas, crude oil and water, said step of heating the mixture in the separator tank including the step of utilizing solar energy by circulating a heat exchange medium from a solar collector through a heat exchange coil in the separator tank, removing the gas from the separator tank, removing the oil from the separator tank, injecting at least a portion of the heated water into the oil bearing formation through an injection well to facilitate recovery of crude oil from the formation, the step of injecting at least a portion of the heated water into the oil bearing formation including the step of storing the separated and heated water temporarily in an outer tank concentric with the separator tank and communicated therewith at a lower end thereof whereby water separated from the crude oil in the separator tank will discharge into the outer tank with the heated water serving to heat the material in the inner separator tank and to insulate the material in the inner separator tank.

4. The method as defined in claim 3 wherein the step of removing the gas from the separator tank includes collection of the gas in a dome trap in an upper end of the separator tank, the step of removing the heated crude oil from the separator tank including communicating a discharge pipe with the separator tank, and insulating the outer tank to reduce heat loss.

5. A system for secondary recovery of oil from an oil formation including a recovery well and at least one injection well spaced therefrom, a separator tank for receiving production fluid from the recovery well including gas, crude oil and water, heating means associated with the separator tank for heating the production fluid and facilitating the separation of gas, crude oil and water, means for collecting gas at an upper end of the separator tank and discharging it to a desired site, means for removing heated crude oil from the separator tank, means communicated with a lower end of the separator tank for removing and storing the heated water, means for utilizing the stored heated water to further heat the production fluid, and means for injecting at least a portion of the heated water into at least one injection well.

6. A system for secondary recovery of oil from an oil formation including a recovery well and at least one injection well spaced therefrom, a separator tank for receiving production fluid from the recovery well including gas, crude oil and water, heating means associated with the separator tank for heating the production fluid and facilitating the separation of gas, crude oil and water, means for collecting gas at an upper end of the separator tank and discharging it to a desired site, means for removing heated crude oil from a central portion of the separator tank, means communicated with a lower end of the separator tank for removing and storing the heated water and injecting at least a portion of the heated water into at least one injection well, said means for removing water from the separator tank including an outer tank concentric with the separator tank and communicated therewith at a bottom thereof for receiving the heated water from the separator tank whereby the heated water serves to heat the production fluid in the separator tank and to insulate the separator tank against heat loss, insulation means on the outer tank to further reduce heat loss and pipe means communicating the outer tank with at least one injection well for injection of heated water into the oil formation.

7. The system as defined in claim 6 wherein said means for collecting gas includes a dome trap in a top wall of the separator tank and a discharge pipe communicating with the trap, said means for removing crude oil including a discharge pipe having an intake end adjacent the central portion of the separator tank.

8. The system as defined in claim 7 wherein said means for heating the separator tank includes a solar collector mounted externally of the separator tank, a tubular heating coil in the solar collector receiving a heat exchange fluid, a heating coil disposed in the separator tank and communicated with the coil in the solar collector for circulation of heat exchange fluid in order to transfer solar energy to the production fluid in the separator tank.

9. The system as defined in claim 8 wherein said heating coil in the separator tank includes a multiple loop system disposed transversely of the separator tank and extending into a lower portion of the outer concentric tank for heating the material in the separator tank and the water in the outer tank.

* * * * *